US008113189B2

(12) United States Patent
Dobbins et al.

(10) Patent No.: US 8,113,189 B2
(45) **Date of Patent: *Feb. 14, 2012**

(54) COMPRESSED GAS GUN HAVING GAS GOVERNOR

(75) Inventors: Jerrold M. Dobbins, Kuna, ID (US); Gerald Dobbins, Nampa, ID (US)

(73) Assignee: Kee Action Sports I LLC, Sewell, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/271,402

(22) Filed: Nov. 14, 2008

(65) Prior Publication Data

US 2009/0064981 A1 Mar. 12, 2009

Related U.S. Application Data

(63) Continuation of application No. 11/352,639, filed on Feb. 13, 2006, now Pat. No. 7,451,755, which is a continuation-in-part of application No. 11/183,548, filed on Jul. 18, 2005, now abandoned.

(60) Provisional application No. 60/588,912, filed on Jul. 16, 2004, provisional application No. 60/654,262, filed on Feb. 18, 2005, provisional application No. 60/652,157, filed on Feb. 11, 2005, provisional application No. 60/654,120, filed on Feb. 18, 2005.

(51) Int. Cl.
*F41B 11/00* (2006.01)

(52) U.S. Cl. ..... 124/71; 124/73; 124/75

(58) Field of Classification Search ..... 124/73–75, 124/77, 76, 71

See application file for complete search history.

(56) References Cited

U.S. PATENT DOCUMENTS

| | | | |
|---|---|---|---|
| 71,162 | A | 11/1867 | Hall |
| 495,767 | A | 4/1893 | Winans |
| 684,055 | A | 10/1901 | Gabbett-Fairfax |
| 2,116,860 | A | 5/1938 | Blaylock |
| 2,568,432 | A | 9/1951 | Cook |
| 2,817,328 | A | 12/1957 | Gale |

(Continued)

FOREIGN PATENT DOCUMENTS

EP 1197 723 A2 4/2002

(Continued)

OTHER PUBLICATIONS

Tippman Pneumatics, Inc., 98 Custom, $CO_2$ Powered Paintball Gun, Owner's Manual.

(Continued)

*Primary Examiner* — Gabriel Klein
(74) *Attorney, Agent, or Firm* — Volpe and Koenig, P.C.

(57) ABSTRACT

A paintball marker has an inline cylinder that includes a gas governor that reduces gas flow from a compressed gas source to a valve area when the bolt is in a firing position; this increases efficiency in the marker because only the required air is used to fire the paintball. This bolt operates independent of the valve pin, which increases cycle speed and enables the governor to open and close at an optimum time in the firing cycle. Further, when the bolt/piston is recocking, the gap between the valve pin and governor valve pin enables low pressure gas driving the piston to start pressurizing the cylinder and driving the piston rearwards without resistance from the high pressure gas. The marker also allows a user to remove the inline cylinder without tools, and provides a convenient carrying handle for holding the paintball marker, which is commonly called a "snatch grip."

18 Claims, 13 Drawing Sheets

U.S. PATENT DOCUMENTS

| | | | |
|---|---|---|---|
| 2,900,972 | A | 8/1959 | Marsh et al. |
| 3,273,553 | A | 9/1966 | Doyle |
| 3,334,208 | A | 8/1967 | Green |
| 3,420,220 | A | 1/1969 | Ferrando |
| 3,630,118 | A | 12/1971 | Stoner |
| 3,788,298 | A | 1/1974 | Hale |
| 3,894,657 | A | 7/1975 | Eckmayr |
| 3,921,614 | A | 11/1975 | Fogelgren |
| 4,044,290 | A | 8/1977 | Gullo |
| 4,147,152 | A | 4/1979 | Fischer et al. |
| 4,148,415 | A | 4/1979 | Florida et al. |
| 4,280,248 | A | 7/1981 | Herubel |
| 4,362,145 | A | 12/1982 | Stelcher |
| 4,446,599 | A | 5/1984 | Karubian et al. |
| 4,695,954 | A | 9/1987 | Rose et al. |
| 4,747,338 | A | 5/1988 | Crutcher |
| 4,748,600 | A | 5/1988 | Urquhart |
| 4,770,153 | A | 9/1988 | Edelman |
| 4,819,609 | A | 4/1989 | Tippmann |
| 4,850,330 | A | 7/1989 | Nagayoshi |
| 4,870,945 | A | 10/1989 | Hutchison |
| 4,922,640 | A | 5/1990 | Toombs |
| 4,936,282 | A | 6/1990 | Dobbins et al. |
| 4,986,164 | A | 1/1991 | Crutcher |
| 5,042,685 | A | 8/1991 | Moulding, Jr. et al. |
| 5,061,222 | A | 10/1991 | Suris |
| 5,070,995 | A | 12/1991 | Schaffer et al. |
| 5,078,118 | A | 1/1992 | Perrone |
| 5,257,614 | A | 11/1993 | Sullivan |
| 5,265,582 | A | 11/1993 | Bhogal |
| 5,280,778 | A | 1/1994 | Kotsiopoulos |
| 5,333,594 | A | 8/1994 | Robinson |
| 5,337,726 | A | 8/1994 | Wood |
| 5,349,938 | A | 9/1994 | Farrell |
| 5,450,839 | A | 9/1995 | Nicolaevich et al. |
| 5,462,042 | A | 10/1995 | Greenwell |
| 5,494,024 | A | 2/1996 | Scott |
| 5,515,838 | A | 5/1996 | Anderson |
| 5,542,406 | A | 8/1996 | Oneto |
| 5,572,982 | A | 11/1996 | Williams |
| 5,605,140 | A | 2/1997 | Griffin |
| 5,613,483 | A | 3/1997 | Lukas et al. |
| 5,630,406 | A | 5/1997 | Dumont |
| 5,634,456 | A | 6/1997 | Perrone |
| 5,673,812 | A | 10/1997 | Nelson |
| 5,704,342 | A | 1/1998 | Gibson et al. |
| 5,727,538 | A | 3/1998 | Ellis |
| 5,769,066 | A | 6/1998 | Schneider |
| 5,771,875 | A | 6/1998 | Sullivan |
| 5,778,868 | A | 7/1998 | Shepherd |
| 5,878,736 | A | 3/1999 | Lotuaco, III |
| 5,881,707 | A | 3/1999 | Gardner, Jr. |
| 5,913,303 | A | 6/1999 | Kotsiopoulos |
| 5,967,133 | A | 10/1999 | Gardner, Jr. |
| 6,003,504 | A | 12/1999 | Rice et al. |
| 6,024,077 | A | 2/2000 | Kotsiopoulos |
| 6,035,843 | A | 3/2000 | Smith et al. |
| 6,065,460 | A | 5/2000 | Lotuaco, III |
| 6,138,656 | A | 10/2000 | Rice et al. |
| 6,142,136 | A | 11/2000 | Velasco |
| 6,233,928 | B1 | 5/2001 | Scott |
| 6,302,092 | B1 | 10/2001 | Juan |
| 6,311,682 | B1 | 11/2001 | Rice et al. |
| 6,349,711 | B1 | 2/2002 | Perry et al. |
| 6,371,099 | B1 | 4/2002 | Lee |
| 6,439,217 | B1 | 8/2002 | Shih |
| 6,470,872 | B1 | 10/2002 | Tiberius et al. |
| 6,474,326 | B1 | 11/2002 | Smith et al. |
| 6,516,791 | B2 | 2/2003 | Perrone |
| 6,532,949 | B1 | 3/2003 | McKendrick |
| 6,550,468 | B1 | 4/2003 | Tippmann, Jr. |
| 6,553,983 | B1 | 4/2003 | Li |
| 6,561,176 | B1 | 5/2003 | Fujimoto et al. |
| 6,568,381 | B2 | 5/2003 | Chang |
| 6,618,975 | B1 | 9/2003 | Shih |
| 6,626,165 | B1 | 9/2003 | Bhogal |
| 6,637,420 | B2 | 10/2003 | Moritz |
| 6,637,421 | B2 | 10/2003 | Smith et al. |
| 6,644,295 | B2 | 11/2003 | Jones |
| 6,644,296 | B2 | 11/2003 | Gardner, Jr. |
| 6,658,982 | B2 | 12/2003 | Cherry |
| 6,668,478 | B2 | 12/2003 | Bergstrom |
| 6,675,791 | B1 | 1/2004 | Alexander et al. |
| 6,694,963 | B1 | 2/2004 | Taylor |
| 6,701,909 | B2 | 3/2004 | Tiberius et al. |
| 6,705,036 | B2 | 3/2004 | Orr |
| 6,708,685 | B2 | 3/2004 | Masse |
| 6,732,464 | B2 | 5/2004 | Kurvinen |
| 6,763,822 | B1 | 7/2004 | Styles |
| 6,766,795 | B1 | 7/2004 | Sullivan |
| 6,802,305 | B1 | 10/2004 | Hatcher |
| 6,810,871 | B2 | 11/2004 | Jones |
| 6,832,605 | B2 | 12/2004 | Farrell |
| 6,860,258 | B2 | 3/2005 | Farrell |
| 6,868,846 | B2 | 3/2005 | Jzn |
| 6,880,281 | B1 | 4/2005 | Orr |
| 6,889,681 | B1 | 5/2005 | Alexander et al. |
| 6,892,718 | B2 | 5/2005 | Tiberius et al. |
| 6,901,684 | B2 | 6/2005 | Ito et al. |
| 6,901,689 | B1 | 6/2005 | Bergstrom |
| 6,901,923 | B2 | 6/2005 | Jones |
| 6,915,792 | B1 | 7/2005 | Sheng |
| 6,925,997 | B2 | 8/2005 | Sheng |
| 6,986,343 | B2 | 1/2006 | Carnall et al. |
| 7,044,119 | B2 | 5/2006 | Jones |
| 7,076,906 | B2 | 7/2006 | Monks et al. |
| 7,086,393 | B1 | 8/2006 | Moss |
| 7,100,593 | B2 | 9/2006 | Smith et al. |
| 7,121,272 | B2 | 10/2006 | Jones |
| 7,185,646 | B2 | 3/2007 | Jones |
| D546,297 | S | 7/2007 | Jones |
| 7,237,544 | B2 | 7/2007 | Jones |
| 7,398,777 | B2 | 7/2008 | Carnall et al. |
| 7,461,646 | B2 | 12/2008 | Jones |
| 7,533,664 | B2 | 5/2009 | Carnall |
| 7,556,032 | B2 | 7/2009 | Jones et al. |
| 7,575,021 | B2 | 8/2009 | Carnall |
| 7,591,262 | B2 | 9/2009 | Jones et al. |
| 7,603,997 | B2 | 10/2009 | Hensel et al. |
| 7,610,908 | B2 | 11/2009 | Gardner, Jr. et al. |
| 7,617,819 | B2 | 11/2009 | Jones |
| 7,617,820 | B2 | 11/2009 | Jones |
| 7,624,723 | B2 | 12/2009 | Gardner, Jr. et al. |
| 7,640,925 | B2 | 1/2010 | Jones |
| 7,640,926 | B2 | 1/2010 | Jones |
| 7,690,373 | B2 | 4/2010 | Telford et al. |
| 7,712,465 | B2 | 5/2010 | Carnall et al. |
| 7,753,042 | B2 | 7/2010 | Carnall et al. |
| 2002/0088449 | A1 | 7/2002 | Perrone |
| 2002/0096164 | A1 | 7/2002 | Perrone |
| 2003/0005918 | A1 | 1/2003 | Jones |
| 2003/0024520 | A1 | 2/2003 | Dobbins |
| 2003/0047175 | A1 | 3/2003 | Farrell |
| 2003/0066520 | A1 | 4/2003 | Chang |
| 2003/0079731 | A1 | 5/2003 | Dobbins |
| 2003/0168052 | A1 | 9/2003 | Masse |
| 2003/0221684 | A1 | 12/2003 | Rice |
| 2004/0084038 | A1 | 5/2004 | Gabrel |
| 2004/0084040 | A1 | 5/2004 | Jones |
| 2004/0200115 | A1 | 10/2004 | Monks et al. |
| 2004/0216728 | A1 | 11/2004 | Jong |
| 2004/0237954 | A1 | 12/2004 | Styles et al. |
| 2004/0255923 | A1 | 12/2004 | Carnall et al. |
| 2005/0028802 | A1 | 2/2005 | Jones |
| 2005/0066952 | A1 | 3/2005 | Lai et al. |
| 2005/0115550 | A1 | 6/2005 | Jones |
| 2005/0115551 | A1 | 6/2005 | Carnall et al. |
| 2005/0115553 | A1 | 6/2005 | Jong |
| 2005/0115554 | A1 | 6/2005 | Jones |
| 2005/0133014 | A1 | 6/2005 | Jones |
| 2005/0155591 | A1* | 7/2005 | Forster ..... 124/74 |
| 2005/0183711 | A1 | 8/2005 | Eichner et al. |
| 2005/0188977 | A1 | 9/2005 | Wygant |
| 2005/0188978 | A1 | 9/2005 | Tiberius et al. |
| 2005/0194558 | A1 | 9/2005 | Carnall et al. |
| 2005/0217655 | A1 | 10/2005 | Jones |
| 2005/0235976 | A1 | 10/2005 | Carnall |

| | | | | |
|---|---|---|---|---|
| 2005/0268894 | A1 | 12/2005 | Styles et al. | |
| 2006/0005823 | A1 | 1/2006 | Quinn et al. | |
| 2006/0011186 | A1 | 1/2006 | Jones et al. | |
| 2006/0011187 | A1 | 1/2006 | Gardner, Jr. et al. | |
| 2006/0011188 | A1 | 1/2006 | Jones | |
| 2006/0107939 | A1 | 5/2006 | Dobbins | |
| 2006/0124118 | A1 | 6/2006 | Dobbins | |
| 2006/0137745 | A1 | 6/2006 | Carnall | |
| 2006/0162712 | A1 | 7/2006 | Yea | |
| 2006/0162714 | A1 | 7/2006 | Lai | |
| 2006/0162715 | A1 | 7/2006 | Jones | |
| 2006/0169264 | A1 | 8/2006 | Lai | |
| 2006/0169266 | A1 | 8/2006 | Carnall et al. | |
| 2006/0207585 | A1 | 9/2006 | Liang | |
| 2006/0207587 | A1 | 9/2006 | Jones et al. | |
| 2006/0225718 | A1 | 10/2006 | Kirwan | |
| 2006/0278206 | A1 | 12/2006 | Dobbins et al. | |
| 2007/0028909 | A1 | 2/2007 | Wood | |
| 2007/0068502 | A1 | 3/2007 | Jones et al. | |
| 2007/0151548 | A1 | 7/2007 | Long | |
| 2007/0181115 | A1 | 8/2007 | Jong | |
| 2007/0186916 | A1 | 8/2007 | Jones | |
| 2007/0209650 | A1 | 9/2007 | Jones | |
| 2007/0215133 | A1 | 9/2007 | Jones | |
| 2007/0215137 | A1 | 9/2007 | Jones et al. | |
| 2007/0295320 | A1 | 12/2007 | Carnall et al. | |
| 2008/0178859 | A1 | 7/2008 | Moore et al. | |
| 2009/0133682 | A1 | 5/2009 | Dobbins | |
| 2010/0083944 | A1 | 4/2010 | Dobbins | |
| 2010/0101550 | A1 * | 4/2010 | Carnall | 124/76 |
| 2010/0108049 | A1 | 5/2010 | Dobbins | |

FOREIGN PATENT DOCUMENTS

| | | |
|---|---|---|
| GB | 631797 | 11/1949 |
| GB | 2198818 | 6/1988 |
| GB | 2313655 | 12/1997 |
| JP | 7225096 | 8/1995 |
| WO | 8805895 | 8/1988 |
| WO | 9813660 | 4/1998 |

OTHER PUBLICATIONS

Tippman Pneumatics, Inc., 98 Custom, CO2 Powered Paintball Gun, Owner's Manual (9 pages).
Indian Creek Design "Freestyle 2004" Operation Manual Version 1.1, 2004 (28 pages).
Indian Creek Design "FreeStyle: 2004" Internet Announcement, 1997 (2 pages).
Paintball 2Xtremes Magazine, "Indian Creek Designs Sponsors CFOA!", Apr. 29, 2004 (3 pages).
Bushmaster™ SI Tournament Marking Gun, Safety and Instruction Manual, 1989, www.icdpaintball.com.
Promaster SI Tournament Marking Gun, Safety and Instruction Manual, 1991, www.icdpaintball.com.
Indian Creek Design BushMaster series, Version 1.2, Model BKO, 1992-2003, www.icdpaintball.com.
BKO, Instruction Manual, Version 1.5, Indian Creek, 1992-2004, www.icdpaintball.com.
Desert Fox, Instruction Manual, Version 1.2, Indian Creek Design, Inc., 1993-1996, www.icdpaintball.com.
Puma™, Version 1.4, Instruction Manual, 1993-1997, www.icdpaintball.com.
Thunder Cat™, Instruction Manual, Version 1.4, Indian Creek Design, Inc., 1993-1997, www.icdpaintball.com.
Bobcat™, Instruction Manual, Version 1.2B, Indian Creek Design, Inc., 1993, 1994, www.icdpaintball.com.
Bob Long's Defiant, Version 1.0, Instruction Manual, 1999, www.icdpaintball.com.
Alley Cat, Instruction Manual, Indian Creek Design, Inc., www.icdpaintball.com.
Indian Creek Design BushMaster series, Version 1.8, Model B2K, 1993-2001, www.icdpaintball.com.
Indian Creek Design BushMaster Series, Version 1.6, Model B2K2, Instruction Manual, Version 1.6, 1993-2001, www.icdpaintball.com.
Indian Creek Design BushMaster series, Model B2K, Version 2.1, Instruction Manual, 1993-2003, www.icdpaintball.com.
B2K PDS, User's Manual, Version 2.1, 1993-2004, Indian Creek Design, www.icdpaintball.com.
B2K Standard, User's Manual, Version 2.1, 1993-2004, Indian Creek Design, www.icdpaintball.com.
"ICD" Freestyle Operation Manual Version 1.1, Mar. 2004, 28 pp.
ICD Internet Announcement, Mar. 24, 2004, 2 pp.
"Paintball 2 Extremes," Apr. 29, 2004, 3 pp.
Matrix Owner's Manual by Dye Precision, Inc., Copyright 2003 (9 pages).
DM4 Owner's Manual by Dye Precision, Inc., Copyright 2003 (20 pages).
AirStar Nova 700, Exploded View Diagram (1 page).
SuperNova Manual by AirStar (9 pages).
NOVA series by AirStar, Troubleshooting Manual (6 pages).
NOVA 700 Breakdown by AirStar (1 page).
NOVA 700 Manual by AirStar (4 pages).
World and Regional Paintball Information Guide (WARPIG) Air Star Super Nova ET by Bill Mills, Copyright 1992-2006 (6 pages).
World and Regional Paintball Information Guide (WARPIG) Air Star Nova FAQ, Copyright 1999 (5 pages).
Mayhem Owner's Manual by Paintball Guns International (11 pages).
Assault 80 Manual by War Machine, Inc., Copyright 2004 (8 pages).
World and Regional Paintball Information Guide (WARPIG) Paintball Magazine, Feb. 2000 The E.T. Super Nova, Staff Report (6 pages).
Paintball 2-Xtremes Magazine, Sep. 1999 (vol. 5 No. 9) Super Nova ET: Airstar Joins Electronics Race (5 pages).
Action Pursuit Games magazine, Jan. 2001 Inside AirStar's Supernova ET by James R. "Mad Dog" Morgan, Sr. (6 pages).
World and Regional Paintball Information Guide (WARPIG) Air Tech Matrix by Bill Mills, Jun. 2001 (10 pages).

* cited by examiner

COMPRESSED GAS GUN HAVING GAS GOVERNOR

CROSS REFERENCE TO RELATED APPLICATIONS

This application is a continuation of U.S. Pat. No. 7,451,755 that issued on Nov. 18, 2008 and is a continuation-in-part of U.S. patent application Ser. No. 11/183,548, filed Jul. 18, 2005, which claims the benefit of U.S. Provisional Nos. 60/588,912 and 60/654,262 filed Jul. 16, 2004 and Feb. 18, 2005 respectively, and also claims the benefit of U.S. Provisional Nos. 60/652,157 and 60/654,120 filed Feb. 11, 2005 and Feb. 18, 2005 respectively, all of which are incorporated by reference as if fully set forth.

BACKGROUND OF THE INVENTION

This invention relates generally to the construction of compressed gas guns and more particularly to the guns designed to propel a liquid containing frangible projectile, otherwise known as a "paintball." As used herein, the term "compressed gas" refers to any mean known in the art for providing a fluid for firing a projectile from a compressed gas gun, such as a CO2 tank, a nitrous tank, or any other means supplying gas under pressure. Older existing compressed gas guns generally use a mechanical sear interface to link the trigger mechanism to the hammer or firing pin mechanism. In these guns, a trigger pull depresses the sear mechanism which allows the hammer, under spring or pneumatic pressure, to be driven forward and actuate a valve that releases compressed gas through a port in the bolt, which propels a projectile from the barrel.

This design, however, has many problems, including increased maintenance, damage after repeated cycles, and a higher amount of force is required to drive the hammer mechanism backwards to be seated on the sear. Also, because the sear and resulting hammer must be made of extremely hard materials, the gun is heavy. Such weight is a disadvantage in paintball, where a player's agility works to his advantage.

To overcome the problems of a mechanical sear, other solutions have been developed. One solution uses a pneumatic cylinder, which uses spring or pneumatic pressure on alternating sides of a piston to first hold a hammer in the rearward position and then drive it forward to actuate a valve holding the compressed gas that is used to fire the projectile. Although the use of a pneumatic cylinder has its advantages, it requires the use of a stacked bore, where the pneumatic cylinder in the lower bore and is linked to the bolt in the upper bore through a mechanical linkage. It also requires increased gas use, as an independent pneumatic circuit must be used to move the piston backwards and forwards. A further disadvantage is that adjusting this pneumatic circuit can be difficult, because the same pressure of gas is used on both sides of the piston and there is no compensation for adjusting the amount of recock gas, used to drive it backwards, and the amount of velocity gas, which is the amount of force used to drive it forward and strike the valve. This results in erratic velocities, inconsistencies, and shoot-down. In addition, this technology often results in slower cycling times, as three independent operations must take place. First, the piston must be cocked. Second, the piston must be driven forward. Third, a valve is opened to allow compressed gas to enter a port in the bolt and fire a projectile. Clearly, the above design leaves room for improvement.

Single-bore designs have been developed which place the cylinder and piston assembly in the top bore, usually behind the bolt. This reduces the height of the compressed gas gun, but still requires that a separate circuit of gas be used to drive the piston in alternating directions, which then actuates a valve to release compressed gas, which drives the bolt forward to launch a paintball. These are generally known as spool valve designs. See, for instance, U.S. Pat. Nos. 5,613,483 and 5,494,024.

Existing spool valve designs have drawbacks as well. Coordinating the movements of the two separate pistons to work in conjunction with one another requires very precise gas pressures, port orifices, and timing in order to make the gun fire a projectile. In the rugged conditions of compressed gas gun use, these precise parameters are often not possible. In addition, adjusting the velocity of a compressed gas gun becomes very difficult, because varying the gas pressure that launches a paintball in turn varies the pressure in the pneumatic cylinder, which causes erratic cycling.

What is needed is a compressed gas gun design that eliminates the need for a separate cylinder and piston assembly and uses a pneumatic sear instead of a pneumatic double-acting cylinder to hold the firing mechanism in place prior to firing a projectile. This allows the gun to be very lightweight and compact, and simplifies adjusting the recock gas used to cock the bolt and the gas used to fire the projectile. A further need exists for an easily removable inline cylinder that can be removed, preferably without using tools, so that the marker can be field-stripped and maintained.

SUMMARY

The current invention addresses these needs. The main advantage is that the inventive inline cylinder includes a gas governor that reduces gas flow from a compressed gas source to a valve area when the bolt is in a firing position; this increases efficiency in the marker because only the required air is used to fire the paintball. This particular design operates independent of the valve pin, which increases cycle speed and enables the governor to open and close at the optimum time in the firing cycle. Further, when the bolt/piston is recocking, the gap between the valve pin and governor valve pin enables low pressure gas driving the piston to start pressurizing the cylinder and driving the piston rearwards without resistance from the high pressure gas.

It allows a user to remove the inline cylinder without the use of tools, and gives the user a convenient carrying handle for holding the paintball marker, which is commonly called a "snatch grip."

Further, the invention uses a safety mechanism that prevents the inline from being removed while the marker is pressurized without the safety, such removal would result in the inline cylinder being driven backwards out of the marker.

BRIEF DESCRIPTION OF THE DRAWING(S)

Other objects of the invention will be more readily apparent upon reading the following description of embodiments of the invention and upon reference to the accompanying drawings wherein.

DETAILED DESCRIPTION OF THE PREFERRED EMBODIMENT(S)

Figure 1:
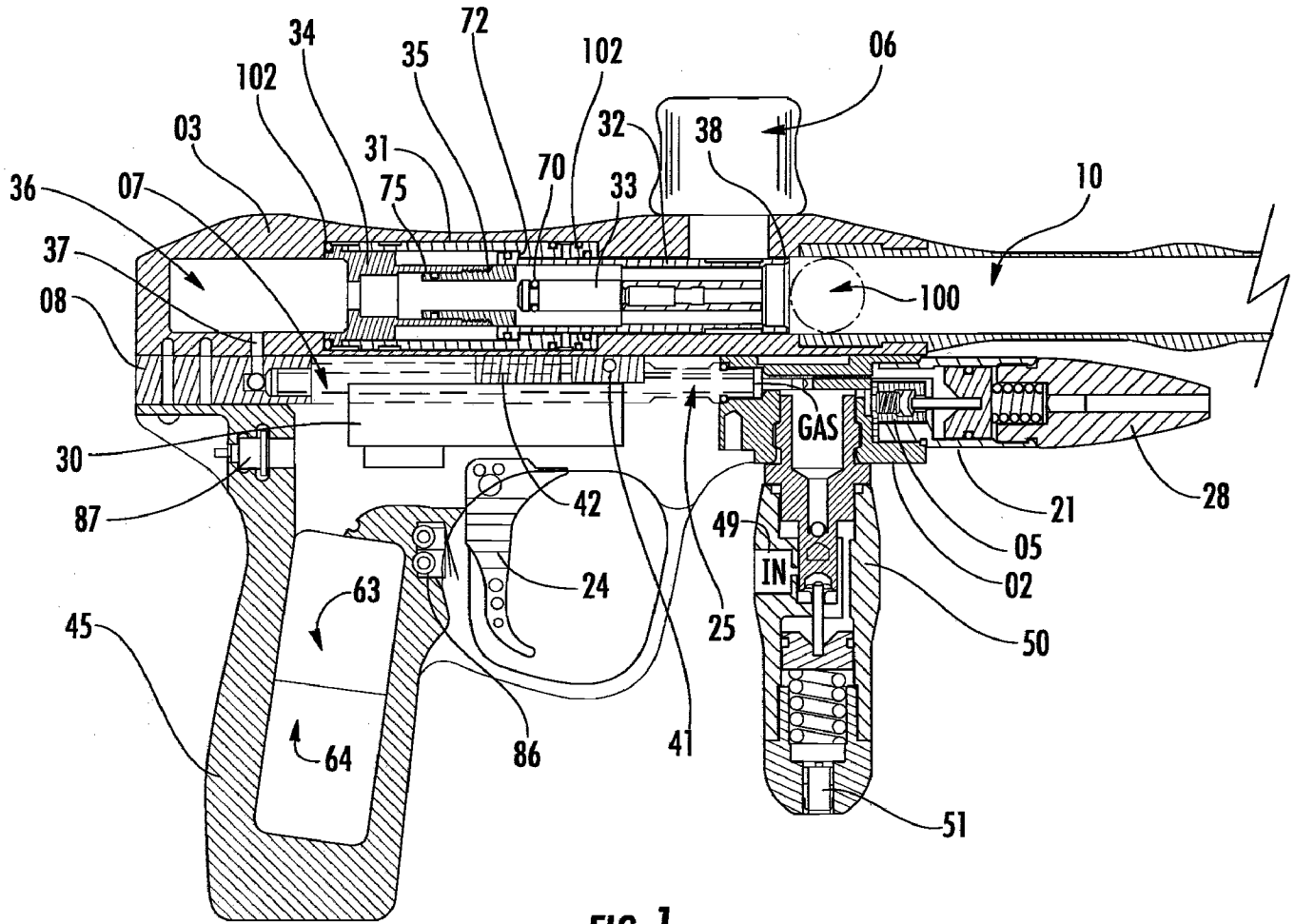
FIG. 1 is a side view of a compressed gas gun utilizing a variable pneumatic sear in the firing position.
Figure 2:
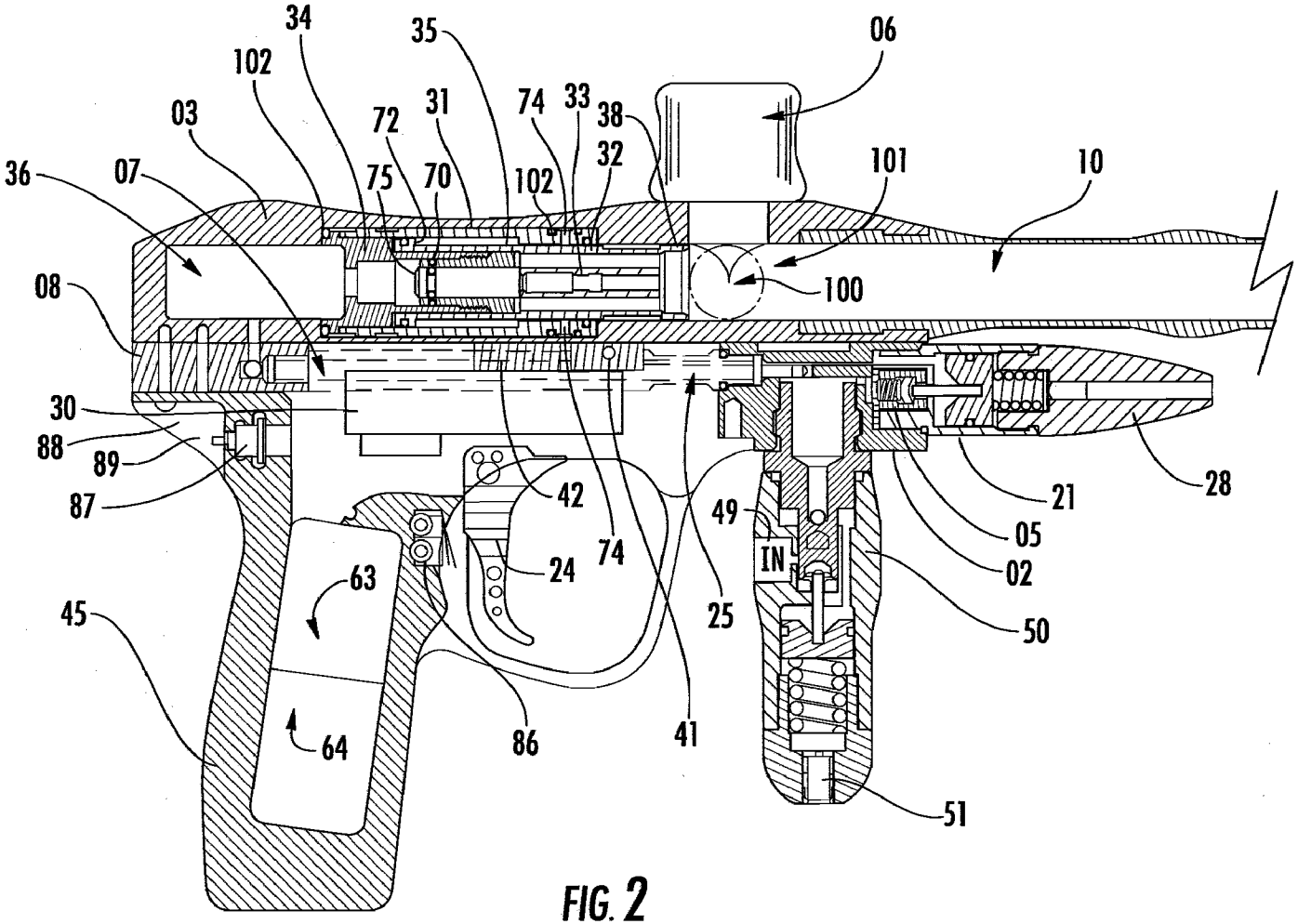
FIG. 2 is a side view of a compressed gas gun utilizing a variable pneumatic sear in the loading position.

FIGS. 1-5 illustrate of a compressed gas gun incorporating a pneumatic sear. Referring to FIGS. 1 and 2, a paintball gun generally comprises a main body 3, a grip portion 45, a trigger 24, a feed tube 6, and a barrel 10. These components are generally constructed out of metal, plastic, or a suitable substance that provides the desired rigidity of these components. Main body 3 generally is connected to a supply of projectiles by feed tube 6 as understood by those skilled in the art. Main body 3 is also connected to grip portion 45, which houses the trigger 24, battery 64 and circuit board 63. The trigger 24 is operated by manual depression, which actuates micro-switch 86 directly behind trigger 24 to send an electrical signal to circuit board 63 to initiate the firing or launching sequence. Barrel 10 is also connected to body 3, preferably directly in front of feed tube 6, to allow a projectile to be fired from the gun.

Hereinafter, the term forward shall indicate being towards the direction of the barrel 10 and rearward shall indicate the direction away from the barrel 10 and towards the rear of main body 3. Preferably forward of the grip portion 45, and also attached to main body 3, the regulator mount 2 houses both the low-pressure regulator 21 and the high-pressure regulator 50. Compressed gas is fed from preferably a compressed gas tank into the input port 49 on high-pressure regulator 50 to be directed to tube 7 to launch a projectile and to be directed to low pressure regulator 21 to cock the bolt tip 38 for loading. Both regulators 21, 50 are constructed from principles generally known to those skilled in the art, and have adjustable means for regulating compressed gas pressure.

Figure 3:
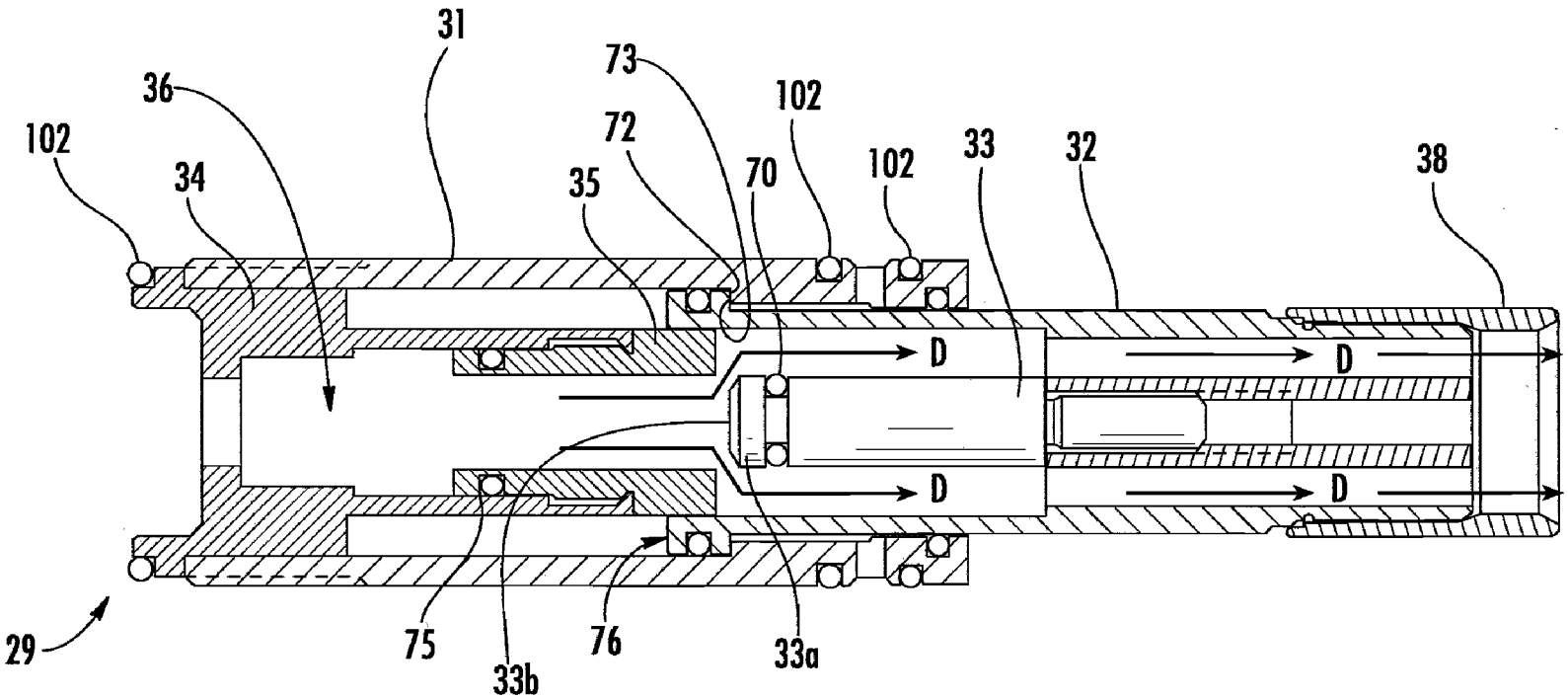
FIG. 3 is an expanded view of the variable pneumatic sear in the loading position.
Figure 4:
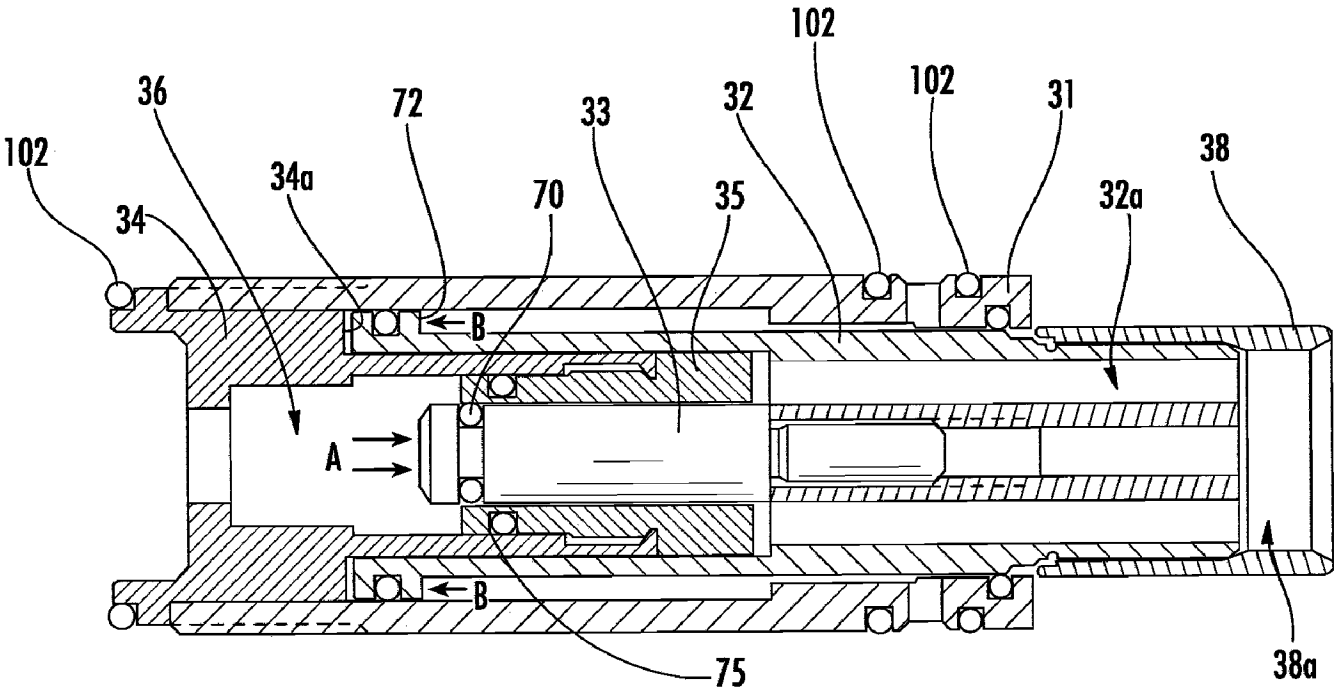
FIG. 4 is an expanded view of the variable pneumatic sear in the launching position.
Figure 5:
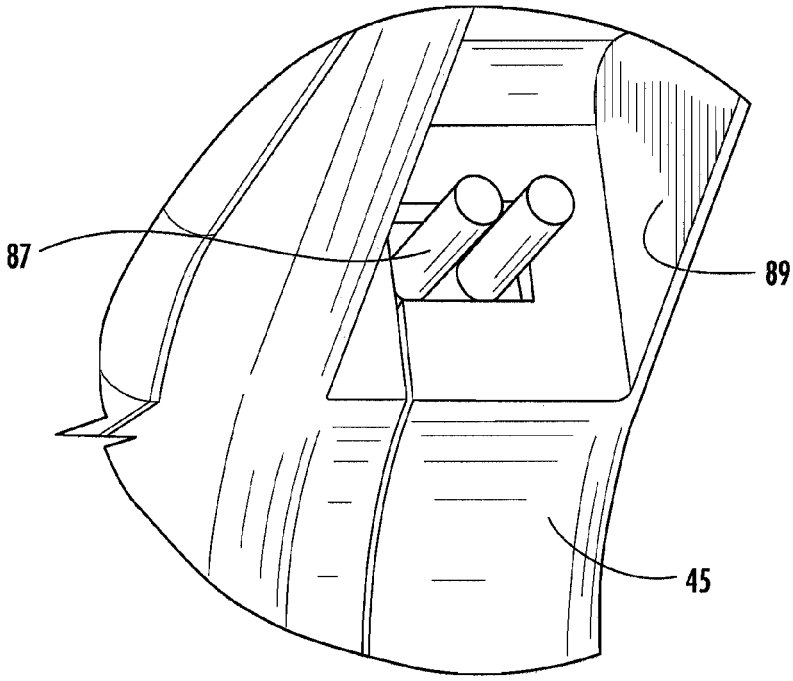
FIG. 5 is an expanded isometric view of the switches located within the recess.

Referring more particularly to FIGS. 3 and 4, housed within main body 3 is the firing mechanism of the gun. The firing mechanism preferably comprises a bolt tip 38, which is preferably constructed out of delrin or metal and is connected to piston 32, housed in cylinder body 31. Piston 32 is also constructed out of delrin or metal, and is connected to valve pin 33, housed on the interior of piston 32. In the loading position, valve pin 33 is forced rearward by compressed gas at a low pressure (described in more detail below) and seal 70 (located on a rearward portion 33*a* of the valve pin 33 ) is pushed against the lip 75 of valve housing tip 35, holding high-pressure compressed gas A on the rearward face 33*b* of valve pin 33 and preventing the flow or high pressure gas through bolt tip 38. All seals, including o-ring 70 are constructed out of urethane, plastic, rubber, silicone, BUNA, TEFLON, or any other substance that effectively prevents gas leakage beyond the surface of the seal. Valve housing tip 35 is integrally connected to valve housing 34, which prevents leakage of high-pressure compressed gas around the valve housing 34. Seals 102 also prevent leakage of high-pressure gas and are placed at connecting section of the various components. Cylinder 31 surrounds valve housing 34 and provides sealed housing for piston 32, which contains a first surface 72 for low pressure gas B to flow into to drive piston 32 rearward and seal valve pin 33 against tip 35. Valve housing 34 preferably contains an interior chamber 36 for storing compressed gas to be used to fire a projectile from the gun.

The variable pneumatic sear 29 of the compressed gas gun of the present invention preferably consists of a control valve 30, a piston 32, residing in preferably sealed cylinder housing 31 as shown in FIG. 1. Control valve 30 directs low pressure compressed gas from low pressure regulator 21 through manifold 41 to the cylinder housing 31, allowing gas to contact first surface of piston 32, driving the piston 32 rearward to seat the valve pin 33 when de-actuated, which is considered the loading position. The low pressure compressed gas is able to drive the piston 32 rearward against high-pressure gas pressure on valve pin 33 because the surface area of first surface 72 of piston 32 is larger than that of the surface of valve pin 33. Control valve 30 preferably consists of a normally open three-way valve. When actuated, a normally open valve will close its primary port and exhaust gas from the primary port, thereby releasing pressure from the first surface of piston 32, through a port 42 drilled into manifold 41. This allows high pressure compressed gas, pushing against the smaller surface area of valve pin 33, to drive valve pin 33 forward and break the seal by o-ring 70 to release the stored gas from valve housing 34. Compressed gas then flows around valve pin 33, through ports 32*a* in piston 32, and out through bolt tip 38 to launch a projectile from the barrel 10.

Control valve 30 is preferably controlled by an electrical signal sent from circuit board 63. The electronic control circuit consists of on/off switch 87, power source 64, circuit board 63, and micro-switch 86. When the gun is turned on by on/off switch 87, the electronic control circuit is enabled. For convenience, the on/off switch 87 (and an optional additional switches, such as that for adjacent anti-chop eye that prevents the bolt's advance when a paintball 100 is not seated within the breech) is located on the rear of the marker, within a recess 88 shielded on its sides by protective walls 89. This location protects the switch 87 from inadvertent activation during play. The switch 87 is preferably illuminated by LEDs.

When actuating switch 86 by manually depressing trigger 24, an electrical signal is sent by circuit board 63 to the control valve 30 to actuate and close the primary port, thereby releasing valve pin 33 and launching a projectile. Once the momentary pulse to the control valve 30 is stopped by circuit board 63, the electronic circuit is reset to wait for another signal from switch 86 and the gun will load its next projectile. In this manner, the electrical control circuit controls a firing operation of the compressed gas gun.

A description of the gun's operation is now illustrated. The function of the pneumatic sear is best illustrated with reference to FIGS. 3 and 4, which depict the movements of piston 32 more clearly. Compressed gas enters the high-pressure regulator 50 through the input port 49. The high-pressure regulator is generally known in the art and regulates the compressed gas to about 200-300 p.s.i. These parameters may be changed and adjusted using adjustment screw 51, which is externally accessible to a user for adjustment of the gas pressure in the high-pressure regulator. This high-pressure gas is used to actuate the firing valve and launch a projectile from the barrel 10 of the compressed gas gun. Upon passing through high-pressure regulator 50, compressed gas is fed both through gas transport tube 7 to the valve chamber 36 via manifold 8, and through port 5 to the low pressure regulator 21. Low-pressure regulator 21 is also generally known in the art. Compressed gas is regulated down to approximately between 50-125 p.s.i. by the low-pressure regulator, and is also adjusted by an externally accessible adjustment screw/cap 28, which is preferably externally manually adjustable for easy and quick adjustment. Compressed gas then passes through port 25 into manifold 41, where electro-pneumatic valve 30 directs it into cylinder housing 31 through low pressure passages 74 and low pressure gas pushes against first surface 72 on piston 32, driving it rearwards and seating seal 70 against valve housing tip 35. Note that piston's 32 movement in the rearward direction is limited by contact between the second surface 76 and a stop 34*a* on the valve housing 34.

This allows bolt tip 38 to clear the breech area of the body 3, in which stage a projectile 100 moves from the feed tube 6 and rests directly in front of bolt tip 38. The projectile is now chambered and prepared for firing from the breech. The high-pressure compressed gas, which has passed into the valve chamber 36 via high pressure passage 37, is now pushing against valve pin 33 on the rear of piston 32. The seal created by o-ring 70 on valve pin 33 is not broken because the force of the low-pressure gas on the first side of cylinder 31 is sufficient to hold the valve pin 33 rearward.

When trigger 24 is depressed, electro-pneumatic valve 30 is actuated (preferably using a solenoid housed within the manifold 41, shutting off the flow of low-pressure gas to housing 31 and venting the housing 31 via manifold 41. This allows the higher pressure gas, which is already pushing against valve tip 33 from the rear, to drive valve tip 33 forward to the firing position and break the seal 70 against the housing 35. Bolt tip 38, which is connected to piston 32, pushes a projectile forward in the breech and seals the feed tube 6 from compressed gas during the first stage of launch because the valve pin 33 is still passing through valve housing tip 35 during this stage. This prevents gas leakage up the tube 6 and positions the projectile for accurate launch. Once the valve pin 33 clears the housing tip 35, a flow passage D is opened, and the higher pressure gas flows through ports 32*a*, 38*a* drilled through the interior of piston 32 and bolt tip 38 and propels the paintball from barrel 10. Note that the piston's 32 movement in the forward direction is limited by contact between the first surface 72 and a shoulder 73 within the cylinder 31.

The signal sent to electro-pneumatic valve 30 is a momentary pulse, so when the pulse ceases, the valve 30 is de-actuated. This allows low-pressure gas to enter cylinder housing 31 and drive valve piston 32 rearwards against the force exerted by high-pressure gas to the seated position and allow loading of the next projectile.

Since piston 32 has a larger surface area on its outside diameter than the surface area on the valve pin 33, low-pressure gas is able to hold high-pressure gas within the valve chamber 36 during the loading cycle of the gun. This is more advantageous than a design where a separate piston is used to actuate a separate valve, because the step of actuating and de-actuating the piston is removed from the launch cycle.

In addition, the pressures of the low pressure gas and high pressure gas may be varied according to user preference, thereby allowing for many variable pneumatic configurations of the gun and reducing problems with erratic cycling caused by using the same gas to control both the recock and launch functions of the gun. Because the mechanical sear is eliminated, the gun is also extremely lightweight and recoil is significantly reduced. The gun is also significantly faster than existing designs because the independent piston operation is eliminated.

In an alternate embodiment, the compressed gas gun can operate at one operating pressure instead of having a high-pressure velocity circuit and a low-pressure recock circuit. This is easily accomplished by adjusting the ratio of the surface sizes of the first surface 72 and the valve pin 33. In this manner, the size of the gun is reduced even more because low-pressure regulator 21 is no longer needed.

FIGS. 6-11 show an alternate embodiment of the paintball marker that shares many elements in common with the marker in FIGS. 1-5—he biggest difference between the embodiments being the inline cylinder 314. Common elements between the inline cylinder 314 in FIGS. 6-11 and the cylinder 14 in FIGS. 1-5 have similar names and numbers between the embodiments and it should be appreciated that low pressure inlet passages 374 and high pressure inlet passages 341 correspond to the low and high pressure inlet passages 74, 37.

The marker of FIGS. 6-11 comprises a main body 3, a grip portion 45, a trigger 24, a feed tube 6, and a barrel 10. The main body 3 comprises a bore 300 therethrough that slidably contains an inline cylinder 314, which houses the paintball marker's firing mechanism.

Figure 10:
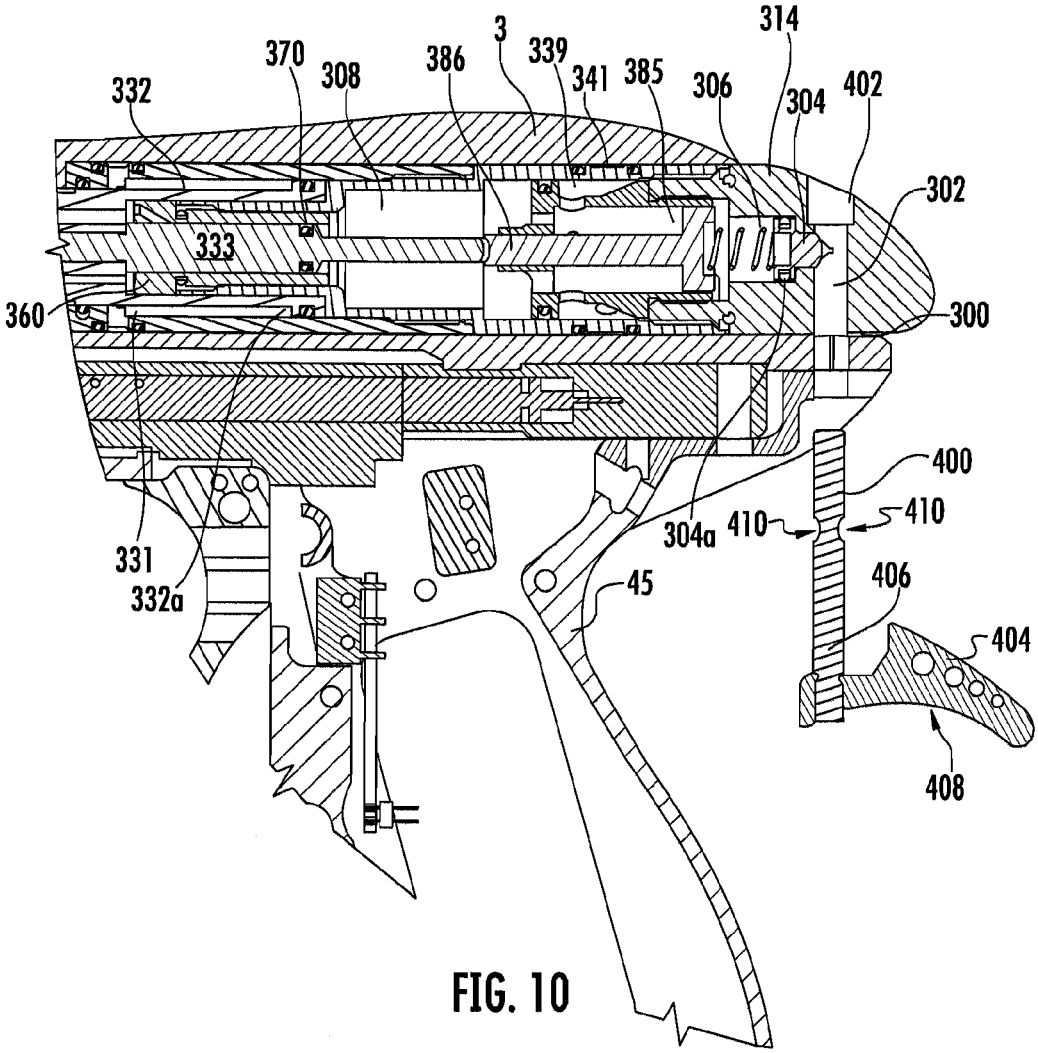
FIG. 10 is a cross section of the rear end of the marker having the inline cylinder of FIG. 6.
Figure 11:
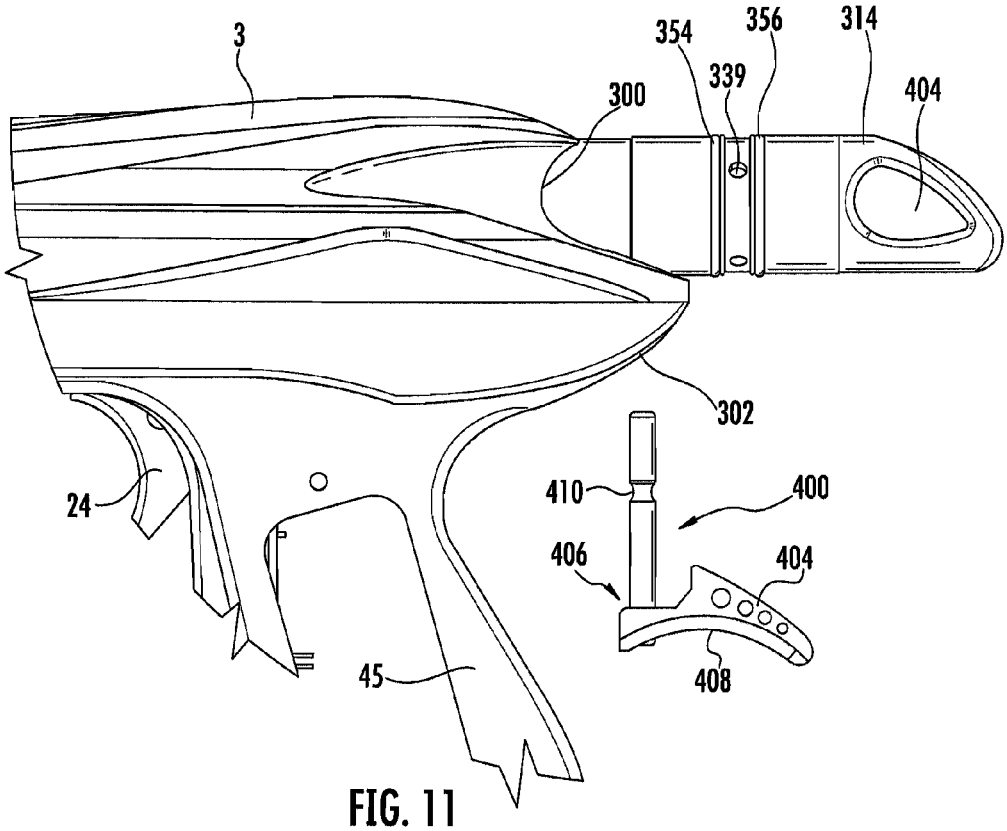
FIG. 11 is an elevation of the rear end of the marker having the inline cylinder of FIG. 6.

When a user removes the mechanical linkage 400 from within the bores 302, 402 as shown in FIGS. 10 and 11, the user can slide the inline cylinder 314 from within the bore 300. The mechanical linkage comprises two joined portions: the handle 404 and the locking pin 406. The handle serves two purposes. First, pressing the handle 404 downwards in relation to the marker body, pulls the locking pin 406 from the bores 302, 402, which allows removal of the inline cylinder 314. This removal can be done without the use of any specialty tools. Second, the convex area 408 serves as a "snatch grip," which is well-known in the filed of paintball markers, and allows a marker to be safely carried during down times in a game—its specific purpose is that it allows transport of a marker without placing a user's hands and fingers near the trigger 24 where they might accidentally discharge the marker.

Figure 8:
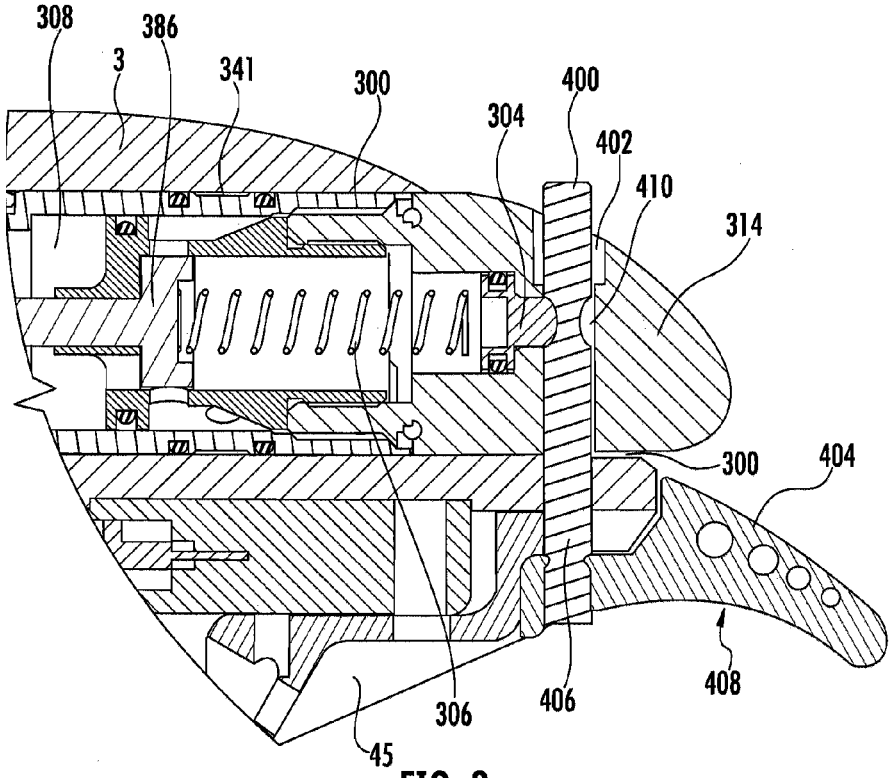
FIG. 8 is a cross section of the rear end of the marker having the inline cylinder of FIG. 6.
Figure 9:
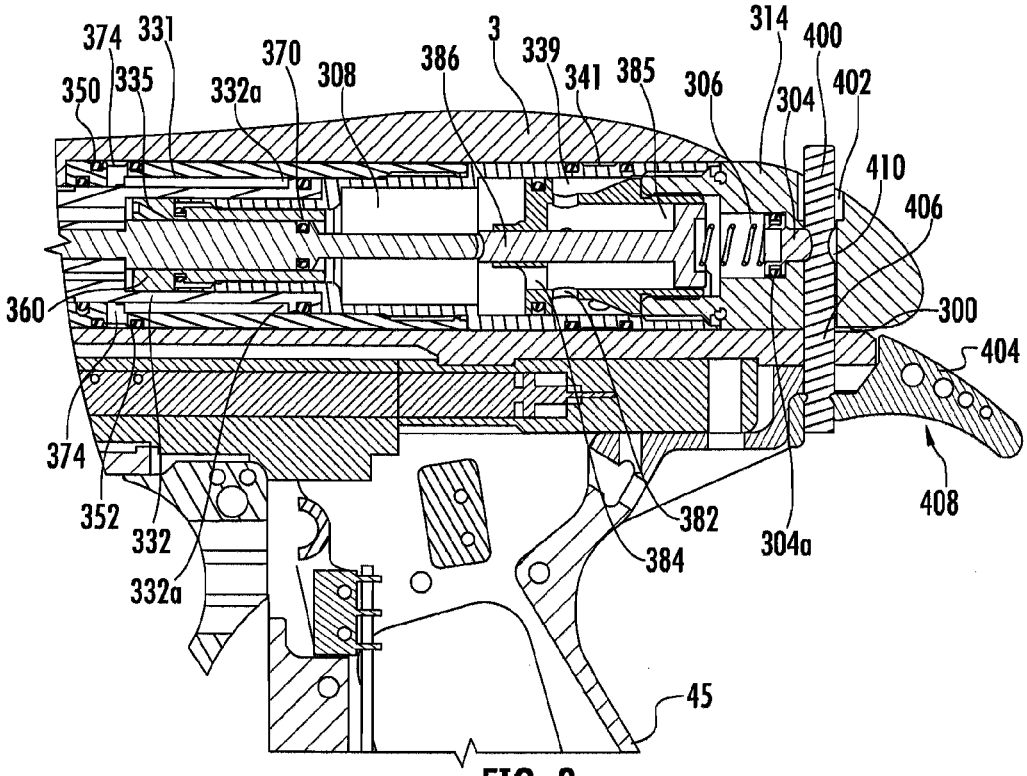
FIG. 9 is a cross section of the rear end of the marker having the inline cylinder of FIG. 6.

The locking pin 406 extends through the bores 302, 402 to lock the inline cylinder 314 within the marker bore 300, and prevent motion between the inline cylinder 314 and the marker. As best seen in FIGS. 8 and 9, a spring 306 biases a button 304 rearwards into the groove 410 to hold the mechanical linkage 400 in place. Further, when high pressure compressed gas fills the firing chamber 308, the compressed gas fills the chamber around the button 304, which is sealed by seal 304*a*, and drives the button 304 rearwards into the groove 410 with such force that a user cannot remove the mechanical linkage from the marker. This prevents the compressed gas from driving the inline cylinder 314 from the marker when it is pressurized.

It should be appreciated, from FIGS. 6, 6A, 7, and 7A particularly, that seals 350, 352, 354, and 356 prevent leakage from the inline cylinder 314 through the bore 300.

The operation of the inline cylinder 314 during the firing cycle will now be described. The control valve 30 directs low pressure compressed gas from low pressure regulator 21 through manifold 41 through the low pressure passages 374 to bolt chamber 331 allowing gas to contact first surface 332*a* of piston 332, driving the piston 332 rearward. Rearward movement of the piston 332 moves the valve pin 333 rearwards, which results in a seal between the seal 370 and the valve housing 360. This is considered the loading position because the piston's tip 338 clears the breech 101 and allows a paintball 100 to drop into the breech 101. (This loading position corresponds to the bolt position in FIG. 2.)

Meanwhile, high pressure gas from the high pressure regulator flows through high pressure passage 341, then through cylinder channels 339, through governor channels 382, into the governor chamber 380, through firing chamber channels 384, and into the firing chamber 308. The low pressure compressed gas drives the piston 332 rearward, overcoming high-pressure gas pressure on valve pin 333 because the surface area of first surface 332*a* of piston 332 is larger than that of the surface area 333*a* of valve pin 333. In this loading position shown in FIGS. 6, 8, 9, and 10, the air flow into the firing chamber 308 is indicated by A.

As with the embodiment of FIGS. 1-5, the control valve 330 preferably is a normally open three-way valve. When actuated in response to a trigger pull, the normally open valve will close its primary port and exhaust low pressure gas from the bolt chamber 331 through the low pressure passage 374, releasing low pressure gas from the first surface 332*a* of piston 332. This allows high pressure compressed gas in the firing chamber 308, pushing against the smaller surface area 333*a* of valve pin 333, to drive the pin 333 and bolt 332 forwards because of contact between the pin 333 and bolt 332. This moves the o-ring 370 forwards of valve housing ports 335, releasing the high pressure gas in the firing chamber 308. The high pressure gas flows into the valve housing 360 around valve pin 333, through ports 335, into a piston passage 337 in piston 332, and out through bolt tip channels 338*a* in bolt tip 338 to launch a projectile 100 from the barrel 10. In this firing position shown in FIGS. 7 and 7A, the air flow to fire the paintball is indicated by A.

Figure 6:
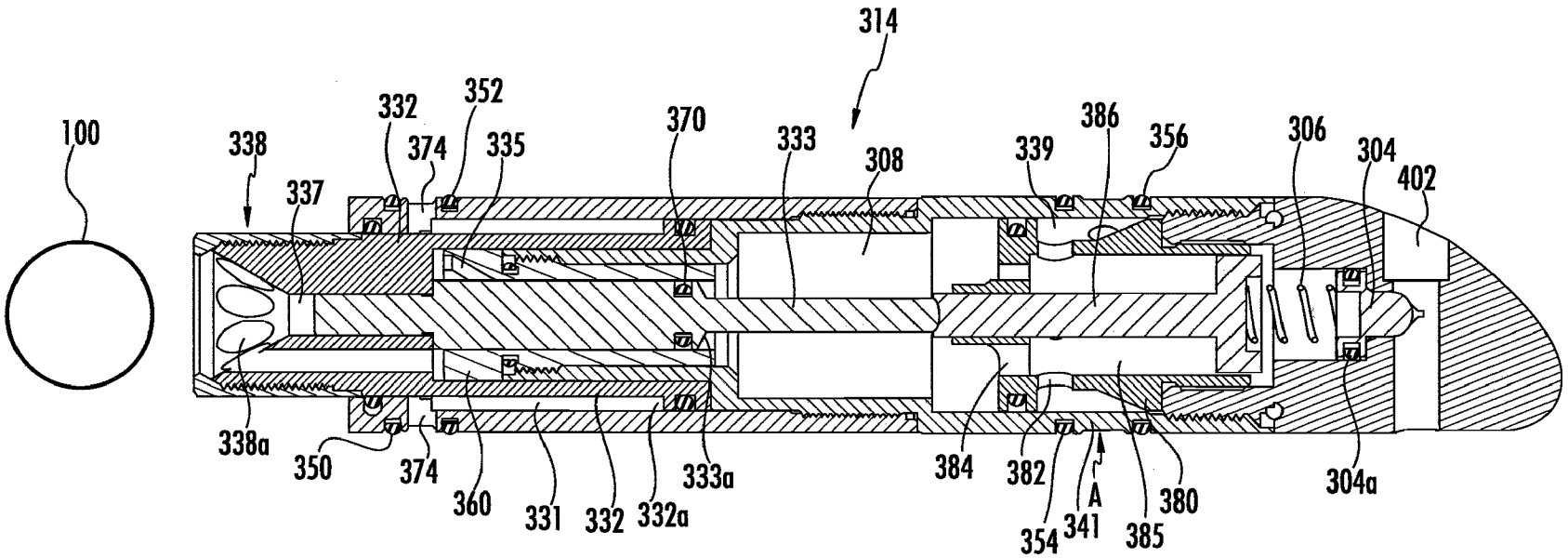
FIGS. 6 and 6A are cross-sections of an alternate embodiment showing an inline cylinder in the loading position.
Figure 6A:
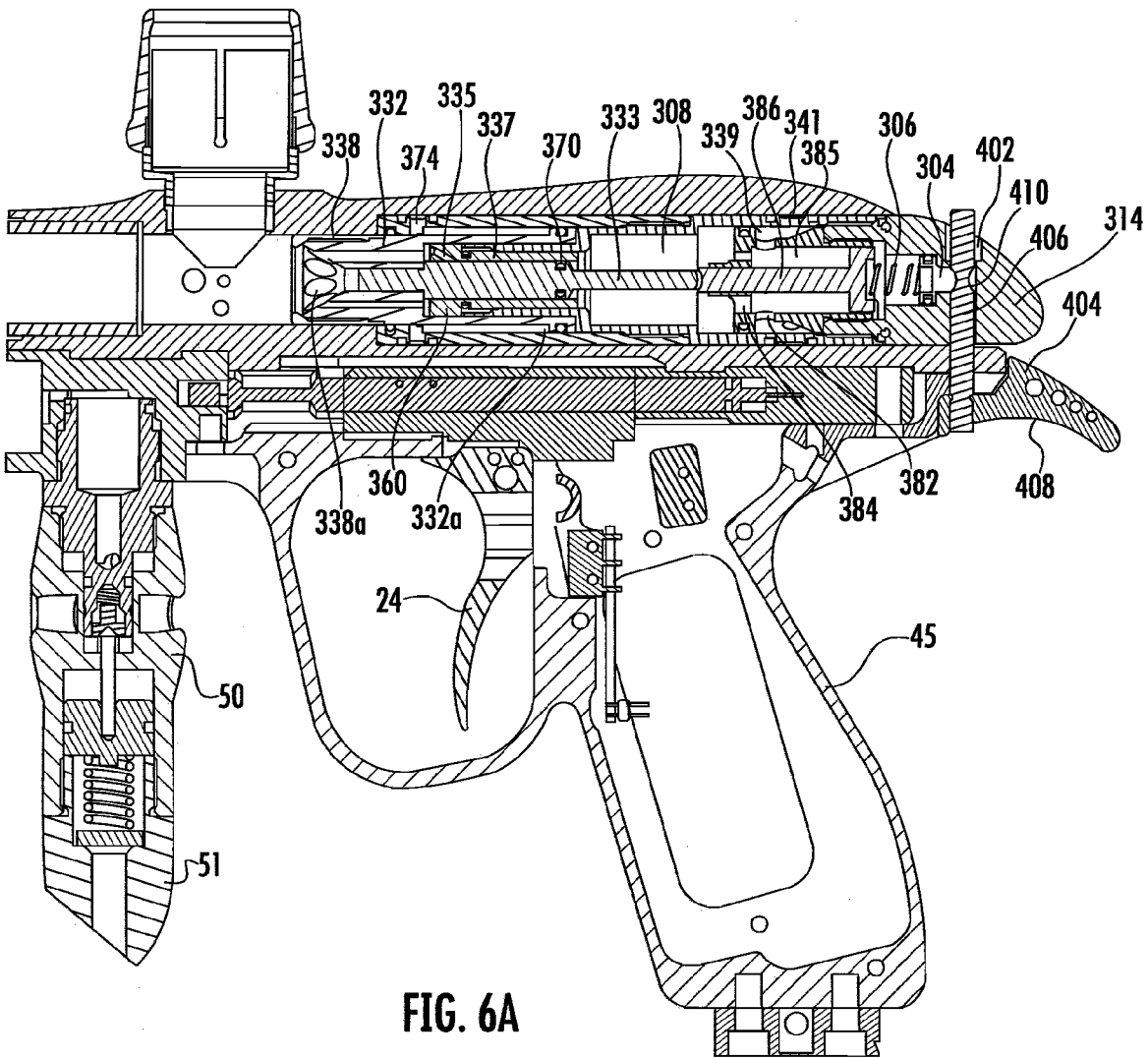
Figure 7:
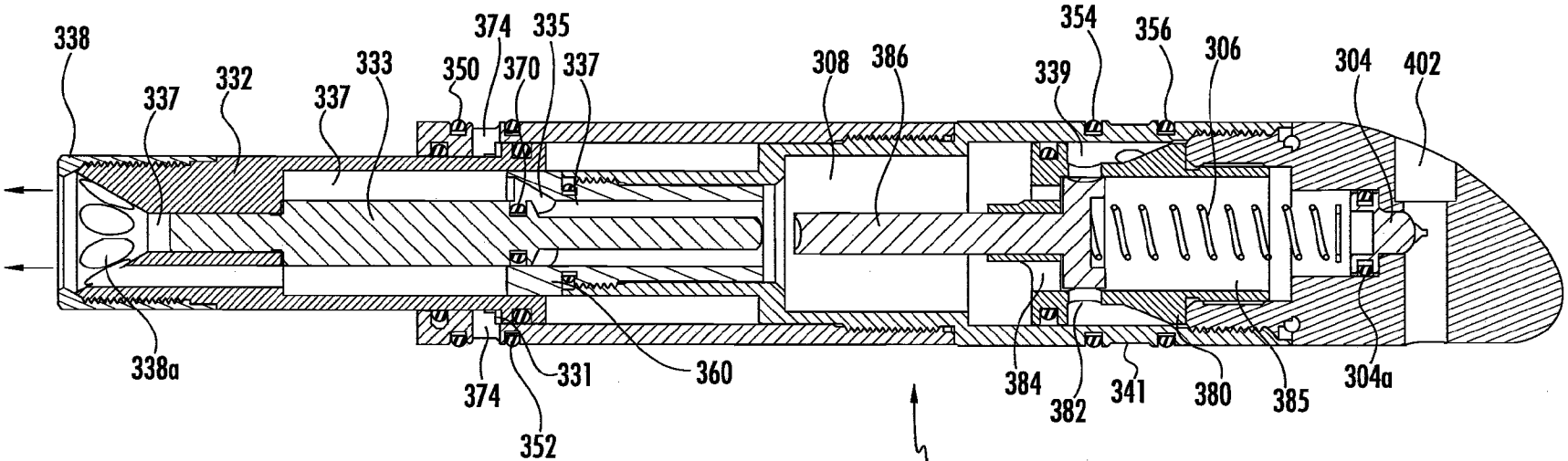
FIGS. 7 and 7A are cross-sections of an alternate embodiment showing an inline cylinder in the firing position.
Figure 7A:
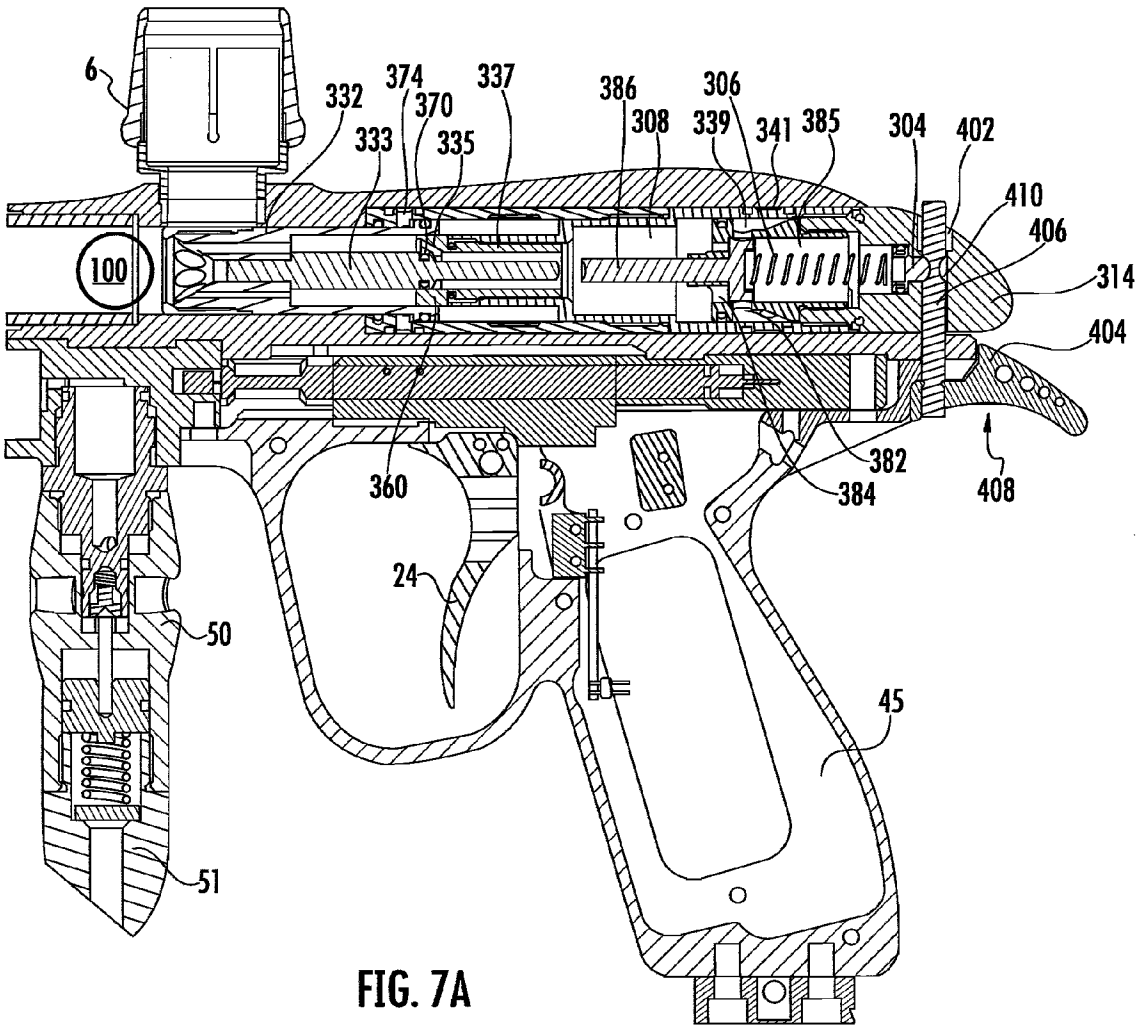

The function of the inline cylinder 314 and gas governor 380 can best be appreciated in FIGS. 6, 6A, 7, and 7A. In FIGS. 6 and 6A, in the loading position, high pressure gas in the gas governor chamber 385 forces the gas governor pin 386 rearward, overcoming a forward bias of the gas governor pin from spring 306. Upon firing, the forward movement of the valve pin 333 combined with the exhaust of the high pressure gas from the barrel 10, allows the spring 306 to drive the gas governor pin 386 forwards to its maximum forward position shown in FIGS. 7 and 7A. In this forward position, the flow of high pressure gas into the firing chamber 308 is cut off because the gas governor pin 386 blocks gas governor ports 382.

This high pressure cutoff results in a faster loading cycle, which begins when the normally open valve low pressure valve reopens and low pressure gas acts on the forward surface 332*a* of bolt 332. The cycle is faster because it does not have to overcome high pressure gas in the firing chamber 308 as the low pressure gas drives bolt 332 rearward, since there is no or little high pressure gas in the firing chamber 308. As the low pressure gas drives the bolt 332 rearward, the valve 333 engages the gas governor pin 386 and drives it backwards to its position in FIGS. 6 and 6A.

The length of the governor pin 386 can also be manipulated to change the timing of the opening and closing of the governor without affecting the firing cycle.

While the present invention is described as a variable pneumatic sear for a paintball gun, it will be readily apparent that the teachings of the present invention can also be applied to other fields of invention, including pneumatically operated projectile launching devices of other types. In addition, the gun may be modified to incorporate a mechanical or pneumatic control circuit instead of an electronic control circuit, for instance a pulse valve or manually operated valve, or any other means of actuating the pneumatic sear.

It will be thus seen that the objects set forth above, and those made apparent from the preceding description, are attained. It will also be apparent to those skilled in the art that changes may be made to the construction of the invention without departing from the spirit of it. It is intended, therefore, that the description and drawings be interpreted as illustrative and that the following claims are to be interpreted in keeping with the spirit of the invention, rather than the specific details. set forth.

It is also to be understood that the following claims are intended to cover all the generic and specific features of the invention herein described and all statements of the scope of the invention that, as a matter of language, might be said to fall therebetween.

The invention claimed is:

1. A compressed gas gun comprising:

a cylinder comprising a piston having a passage therethrough and a valve pin, wherein the piston is axially slidable from a rearward position to a forward position within the cylinder and movement of the piston also moves the valve pin, at least a portion of the valve pin positioned coaxially within the passage of the piston;

a valve housing having a passage therethrough positioned within the cylinder, at least a portion of the valve housing coaxially receivable within the passage of the piston, at least a portion of the valve pin coaxially receivable within the passage of the valve housing, wherein movement of the piston and valve pin relative to the valve housing selectively controls the flow of compressed gas through the valve housing;

compressed gas at a first pressure that biases the valve pin and piston toward the forward position;

compressed gas at a second pressure that biases the valve pin and piston toward the rearward position, and overcomes a force exerted by the first pressure biasing the valve pin and piston toward the forward position; and a valve that, in response to a signal, decreases the second pressure enough to allow the compressed gas at the first pressure to move the valve pin and piston toward the forward position; and a gas governor positioned in the cylinder in a gas governor chamber, the gas governor positionable to selectively engage the valve pin to restrict movement of the valve pin toward the rearward position, the gas governor configured to selectively prevent compressed gas from the gas governor chamber from communicating with the piston.

2. The gun of claim 1, further comprising:

a source of compressed gas that supplies compressed gas at the first pressure; and a regulator that decreases the first pressure to the second pressure.

3. The gun of claim 2, wherein the second pressure is adjustable.

4. The gun of claim 2, wherein the regulator is adjustable by turning an externally accessible adjustment cap.

5. The gun of claim 1, wherein the valve decreases the second pressure by venting the compressed gas at a second pressure.

6. The gun of claim 1, wherein the compressed gas at a second pressure is vented through a manifold.

7. The gun of claim 1, further comprising:

a trigger that when depressed, sends the signal to the valve.

8. The gun of claim 5, wherein the signal is pulsed in such a manner that once the compressed gas at the first pressure is released, the valve ceases decreasing the second pressure.

9. The gun of claim 1, wherein a direction toward the forward position corresponds to a direction a projectile is traveling when it exits the gun, and a direction toward the rearward position is a direction substantially opposite that of the forward direction.

10. The gun of claim 9, further comprising a firing chamber configured to receive compressed gas positioned at a rear portion of the piston, the valve housing further comprising a valve housing port, and a seal that selectively controls the communication of gas between the valve housing port and the firing chamber.

11. The gun of claim 10, wherein the compressed gas at the first pressure flows through the valve housing port when the valve pin is in its forward position.

12. The compressed gas gun of claim 1, where an axial position of the gas governor is adjustable.

13. A compressed gas gun, having a barrel from which a projectile exits in a forward direction, the opposite of the forward direction being rearward, comprising:

a cylinder comprising a piston having a passage therethrough, a valve pin, and a gas governor, all substantially axially aligned with each other within the cylinder, wherein the piston, valve pin, and gas governor are axially slidable within the cylinder and movement of the piston also moves the valve pin, and wherein movement of the valve pin in a rearward direction results in contact between the valve pin and the gas governor and consequent movement of the gas governor in the rearward direction, at least a portion of the valve pin positioned coaxially within the passage of the piston;

wherein the piston and valve pin have a firing position corresponding to a position in which compressed gas at a first pressure drives the projectile from the barrel, and a loading position in which compressed gas at a second pressure prevents the projectile from being driven from the barrel, in which:

in the firing position, compressed gas from a compressed gas source at the first pressure flows around the valve pin and through the piston to fire a paintball, and the gas governor stops the flow of compressed gas at the first pressure between the compressed gas source and the piston; and in the loading position, the compressed gas at the second pressure drives piston and valve pin rearward, said rearward movement of the valve pin stopping the flow of high pressure gas through the piston, said rearward movement of the valve pin also driving the governor pin rearward and allowing the flow of compressed gas at the first pressure between the compressed gas source and the piston; and the gas governor positioned in the cylinder in a gas governor chamber, the gas governor positionable to selectively engage the valve pin to restrict movement of the valve pin.

14. A compressed gas driven gun comprising:

a cylinder comprising a piston having a passage therethrough, a valve pin, and a gas governor, all substantially coaxial with one another, wherein the piston, valve pin, and the gas governor are all slidably movable in relation to the cylinder, at least a portion of the valve pin positioned coaxially within the passage of the piston;

compressed gas at a first pressure that biases the valve pin and piston in a first direction, wherein the compressed gas at the first pressure has an adjustable flow regulated by the gas governor;

compressed gas at a second pressure that biases the valve pin and piston in a second direction, and overcomes a force exerted by the first pressure biasing the piston in the first direction so that the piston moves in the second direction; and a valve that, in response to a signal, decreases the second pressure enough to allow the compressed gas at a first pressure to bias the piston in the first direction, which in turn releases the compressed gas at a first pressure to fire a projectile from the gun, and the gas governor positioned in the cylinder in a gas governor chamber, the gas governor positionable to selectively engage the valve pin to restrict movement of the valve pin in the second direction, the gas governor configured to selectively prevent compressed gas from the gas governor chamber from communicating with the piston.

15. A compressed gas gun comprising:

a gun body including a cylinder;

a piston having a passage therethrough positioned within the cylinder, the piston comprising a bolt and a valve pin, the piston, bolt and valve pin slidable from a rearward position to a forward position, at least a portion of the valve pin positioned coaxially within the passage of the piston;

a valve housing having a passage therethrough positioned within the cylinder, wherein movement of the piston, bolt and valve pin relative to the valve housing selectively controls the flow of compressed gas through the valve housing to fire a projectile from the gun;

a firing chamber positioned in the cylinder adjacent the valve housing and in communication with the valve housing, the firing chamber configured to receive compressed gas from a gas governor chamber;

a gas governor chamber positioned in the cylinder adjacent the firing chamber and in communication with the firing chamber;

a gas governor positioned in the gas governor chamber slidable from a rearward position to a forward position, the gas governor biased toward the forward position by a spring, the valve pin configured to releasably engage the gas governor when the valve pin is in the rearward position, wherein engagement of the valve pin and the gas governor permits compressed gas from the gas governor chamber to communicate with the firing chamber, wherein the valve pin disengages the gas governor when the valve pin is in the forward position.

16. The compressed gas gun of claim 15, wherein compressed gas received at a first pressure biases the valve pin, bolt and piston toward the forward position;

and wherein compressed gas at a second pressure biases the valve pin and piston toward the rearward position, the compressed gas at the second pressure configured to overcome a force exerted by the compressed gas at the first pressure.

17. The compressed gas gun of claim 15, wherein at least a portion of the valve pin is coaxially receivable within the passage of the valve housing.

18. The compressed gas gun of claim 16, further comprising:

a valve that, in response to a signal, decreases the second pressure to allow the compressed gas at the first pressure to move the piston, bolt and valve pin toward the forward position, which movement of the piston, bolt and valve pin toward the forward position permits compressed gas at the first pressure to pass through the passage of the valve housing to fire a projectile from the gun.

* * * * *